United States Patent [19]

Jankowski

[11] 3,931,649

[45] Jan. 13, 1976

[54] TOILET ANTI-SPLASH GUARD

[76] Inventor: Ollie F. Jankowski, 17738 W. Rogers Drive, New Berlin, Wis. 53151

[22] Filed: Nov. 30, 1973

[21] Appl. No.: 420,687

[52] U.S. Cl. ..... 4/1; 4/99; 4/134; 4/DIG. 5; D23/53

[51] Int. Cl.[2] ..... A47K 17/02

[58] Field of Search ..... 4/1, 134, 135, DIG. 5, 4/185 R, 237, 99, 110; D23/53

[56] References Cited

UNITED STATES PATENTS

| | | | |
|---|---|---|---|
| 2,980,919 | 4/1961 | Otto et al. | 4/1 |
| 3,193,845 | 7/1965 | Funk | 4/1 |
| 3,350,722 | 11/1967 | Moreschini | 4/1 |

FOREIGN PATENTS OR APPLICATIONS

| | | | |
|---|---|---|---|
| 64,967 | 11/1949 | Netherlands | 4/DIG. 5 |

*Primary Examiner*—John W. Huckert
*Assistant Examiner*—Stuart S. Levy
*Attorney, Agent, or Firm*—Clarence A. O'Brien; Harvey B. Jacobson

[57] ABSTRACT

Anti-splash attachment means for the flush water circulating rim on a conventional-type toilet bowl. It comprises a first C-shaped strap member which is opposed to inner peripheral surface portions of the encompassing flush rim, said strap member having circumferentially spaced U-shaped stainless steel or equivalent clips. These clips are yieldingly clasped over and clamped on the rim. Vertically disposed guides, more particularly, closed-bottom socket members are fixed to the respective clips and are interiorly provided with suitably nested coil springs. The anti-splash guard or shield comprises a second C-shaped strap member slidingly keyed in slots provided therefor in the socket members. The springs engage and yieldingly project the guard to an elevated position. When the usual hinged seat ring, with or without the cover, is lowered it engages and forces the guard down to a retracted out-of-use position.

4 Claims, 4 Drawing Figures

TOILET ANTI-SPLASH GUARD

This invention relates to certain new and useful improvements in an anti-splash attachment for a toilet bowl and has to do, more particularly, with readily applicable and removable adapter means which is clipped on the usual flush rim and is provided with novel means for retentively positioning a spring-biased vertically raisable and lowerable anti-splash guard.

For background information and, as exemplary of the state of the art, reference may be made to several prior patents, namely, U.S. Pat. Nos. 2,980,919; 2,583,718 and 3,071,778. Unlike these prior patents, the herein-disclosed adaptation pertains to a bowl rim attachment characterized by an anti-splash shield or guard which is designed and adapted to recede within the confines of the bowl when the usual hinged seat ring, with or without the covering lid, is manually lowered to a position of use atop the aforementioned flush rim.

Briefly, the attachment features two companion units, one of which is set forth as applicable and removable adapter means and comprises a C-shaped strap member which is shaped and proportioned to coact with the inner peripheral surface of the flush rim. This strap member is equipped with circumferentially fixed U-shaped spring clips which conformingly and retentively clamp over the flush rim and whose interior median or bight portions are each equipped with a cylindrical vertical socket member. The closed bottom portion has a suitably tensioned coil spring nested therein. The upper open end portion has diametrically opposite guide slots for the relatively movable unit, that is, the second C-shaped strap member which is raisable and lowerable and provides the automatic anti-splash shield or guard.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 2:
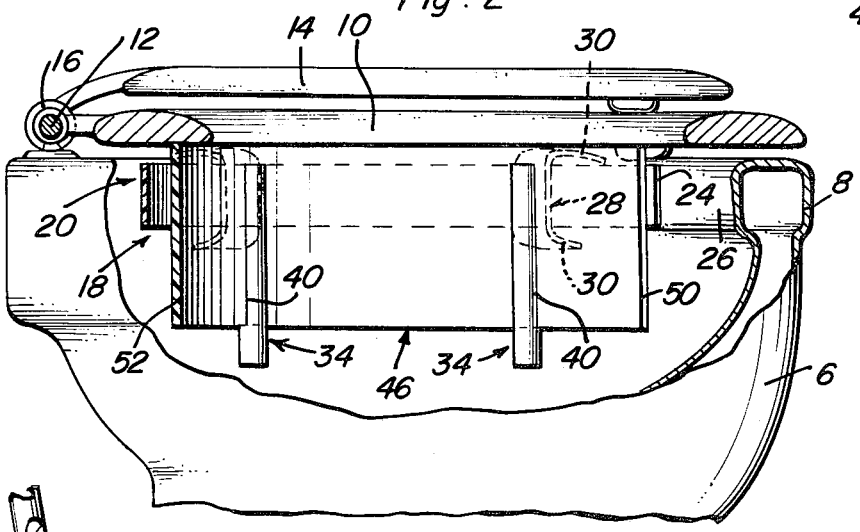
FIG. 2 is a central view based on FIG. 1 but including the cover and seat ring and with parts appearing in section and elevation and showing the raisable and lowerable anti-splash guard or shield in its down or out-of-the-way position.

With reference now to the views of the drawing, the toilet bowl, which is of any suitable and conventional construction is denoted, generally stated, by the numeral 6, the upper open portion thereof being provided with an appropriate flush water circulating and distributing rim 8. The seat ring which is denoted at 10 in FIG. 2 is hingedly mounted as at 12. The companion lid or cover is denoted by the numeral 14 and it likewise is hingedly mounted as at 16.

The self-contained anti-splash attachment is characterized, as already comprehended by a unit which is referred to broadly as adapter means 18. It may be stated in this connection that the component parts are all made of stainless steel or equivalent plastic material wherein the component parts lend themselves to periodical cleaning for sanitary purposes.

Figure 4:
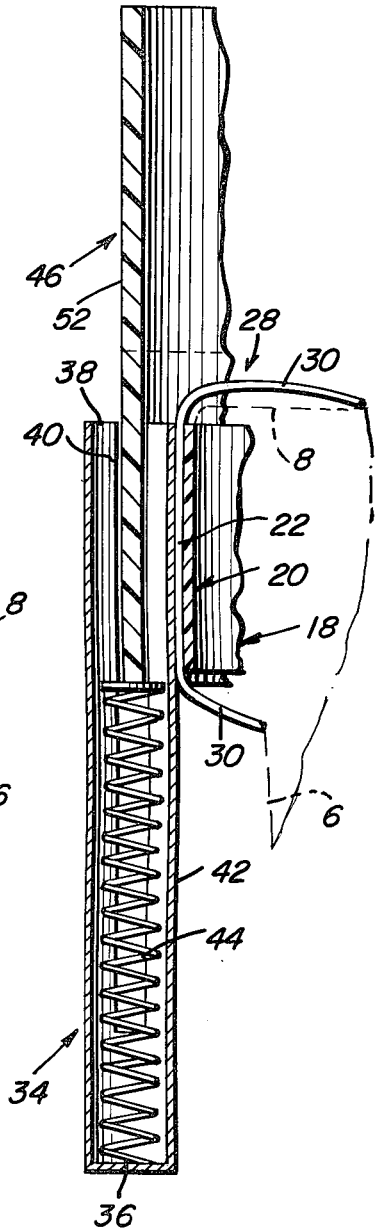
FIG. 4 is an enlarged fragmentary detail view taken approximately on the plane of the section line 4—4 of FIG. 1 looking in the direction of the indicating arrows.

The first C-shaped rust and soil resistant strap member, a significant part of the means 18, is denoted by the numeral 20 and embodies (see FIG. 1) a suitably curvate bight portion 22 and arcuately or longitudinally bowed limb or arm portions 24, the strap member being of requisite size to properly oppose the inner peripheral surface 26 of the aforementioned rim 8. This strap member is provided at circumferentially spaced points with permanently attached substantially U-shaped spring attaching and retaining clips 28 which are constructed so that the jaw portions 30 can be retentively clamped and clipped over the rim 8. It will be noted that the median or bight portions 32 are fixed to the interior surface of the strap member and are suitably designed and constructed to permit the attachment thereto of the aforementioned circumferentially spaced vertically disposed guides. Each guide comprises a vertically disposed and elongated cylindrical socket member 34 having a closed bottom as at 36 (FIG. 4). A portion of one side of the socket member is welded or otherwise secured to the bight portion 32 of the bracket-type clip. The upper open end portion is denoted at 38, this portion being provided with diametrically opposite guide slots 40 which are closed at lower ends but open through the upper open end 38 as is perhaps best shown in FIG. 4. The receiver portion of the socket member, that is the portion 42 in FIG. 4, serves to accommodatingly receive and nest a suitably tensioned coil spring 44.

Figure 1:
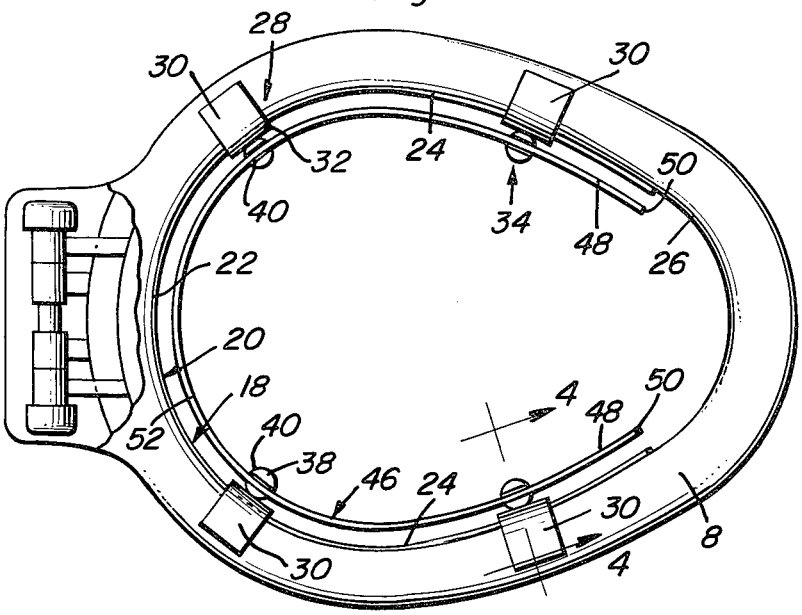
FIG. 1 is a top plan view of a conventional type toilet bowl with portions at the left broken away, with the cover and seat ring omitted and showing, in top plan, the anti-splash attachment and how it is constructed and applied for use.
Figure 3:
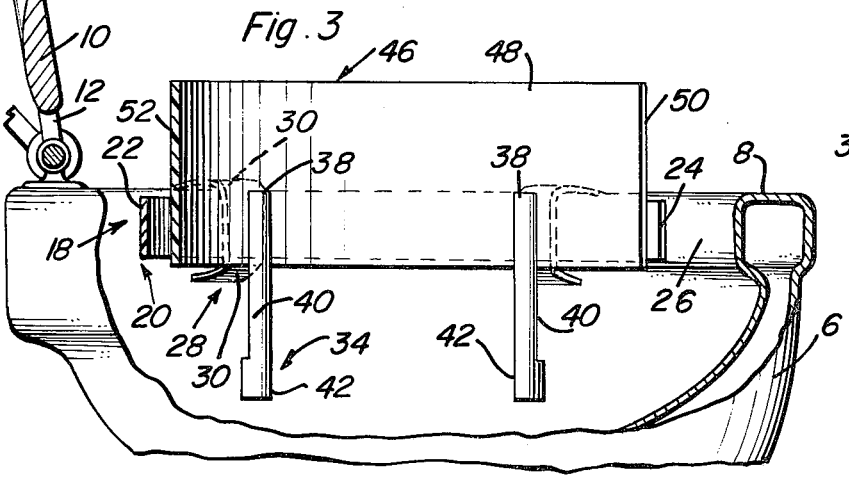
FIG. 3 is a view similar to FIG. 2 and showing the anti-splash guard in its elevated position.

The second unit, more particularly the anti-splash guard or shield is denoted by the numeral 46 and it too is made of rust and soil resistant stainless steel and is of requisite size and preferably C-shaped in plan as is evident in FIG. 1. The limb or leg portions of this guard are denoted at 48, the free tip portions being denoted at 50. The curvate median or bight portion is denoted at 52 (FIG. 1). The lower half or edge portion of this C-shaped guard or shield is slidingly keyed in the aforementioned guide slots 40. Thus the shield is spring-biased or spring-loaded and is referred to as automatically raisable and lowerable. Assuming that the seat ring 10 and cover are in an up out-of-the-way position as suggested in FIG. 3 it will be evident that the springs in the cylindrical socket members exert upward yielding pressure on the lower edge portion of the guard and it is therefore raised to assume the anti-splash position illustrated in FIGS. 3 and 4. When the seat ring 10 is lowered to the position shown in FIG. 2 with or without the cover the weight of the ring exerts pressure on the upper edge portion of the shield and the shield is forced to a down out-of-the-way position.

It is submitted that the views of the drawing taken in conjunction with the description will enable the reader to obtain a clear and comprehensive understanding of the two units and the manner in which they are combined and used. Then, too, the purpose and features and advantages of the invention are believed to be self-evident. Accordingly, a more extended description is deemed to be unnecessary.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a water closet including a toilet bowl having an upper open portion wholly surrounded by a conventional-type overhanging flush water circulating and distributing rim, a hingedly mounted liftable and lowerable seat ring positionable atop said rim, and a hingedly mounted lid-type cover for said seat ring, adapter means mounted on said rim, and an anti-splash guard carried by said adapter means and interposed between said rim and seat ring, said adapter means being relatively stationary and including resilient means contacting the guard for permitting retraction of the guard, said guard being vertically projectable and retractable and automatically projected to an upstanding anti-splash position by the resilient means when the seat ring and companion cover are elevated and being adapted to retract to a down out-of-the-way position when the seat ring is lowered to an in-use position atop said flush rim, said adapter means including fixedly mounted guides, and the resident means being tensioned coil springs arranged in the guides, and said guard comprising an anti-splash shield having portions therein slidingly mounted in said guides and coacting with and acted upon and automatically biased upwardly by said springs, and said adapter means comprising a first soil and rust resisting strap member which is substantially C-shaped in plan, said strap member having rigidly mounted rim gripping and clamping spring clips, said guides comprising vertical socket members closed at their lower ends, open at their upper ends, the upper half-portion of each socket member having guide slots in which a lower edge portion of said guard is retentively but slidingly keyed, and the lower socket portion of each socket member having one of said tensioned coil springs housed therein and operatively engaging the coordinating portion of said guard.

2. The combination defined in claim 1, and wherein said guard also comprises a soil and rust resisting bandtype strap member conformingly shaped to said first named strap member and likewise C-shaped in plan.

3. An anti-splash attachment for the flush water circulating rim on a toilet bowl, the attachment comprising, in combination:

a. an anti-splash guard substantially C-shaped in plan and including a pair of leg portions terminating in free tip portions, and a bight portion between the leg portions, the guard further including a lower edge portion and a spaced, parallel upper edge portion, both extending along the bight and leg portions; and b. adapter means conformingly, detachably connectible with a coacting inward peripheral surface of a toilet bowl flush water circulating rim for receiving the lower edge of the anti-splash guard and supporting on and carrying the anti-splash guard, the adapter means including resilient means for permitting retraction of the anti-splash guard under pressure of a seat ring associated with the toilet bowl on the upper edge portion of the anti-splash guard, said adapter means comprising a first strap member which is substantially C-shaped in plan, and includes a curvate bight portion and longitudinally bowed limbs, said limbs having circumferentially spaced U-shaped rim gripping strap positioning and retaining clips, the median portion of each clip having a fixedly mounted vertical socket member, said socket member having a closed-bottom portion, the resilient means being a suitably tensioned coil spring disposed in the closed-bottom, the upper portion of said socket member being open and provided with diametrically opposite keying and guiding slots in which coordinating portions of said guard are slidingly and yieldingly keyed.

4. The anti-splash attachment defined in claim 3, and wherein said guard has the lower edge portions of its leg portions guidingly keyed in the slots provided therefor.

* * * * *